US008585324B2

(12) United States Patent
Palfinger

(10) Patent No.: US 8,585,324 B2
(45) Date of Patent: Nov. 19, 2013

(54) MAINTENANCE PLATFORM FOR OFF-SHORE CONSTRUCTION

(75) Inventor: Hubert Palfinger, Salzburg (AT)

(73) Assignee: Palfinger Systems GmbH, Salzburg (AT)

( * ) Notice: Subject to any disclaimer, the term of this patent is extended or adjusted under 35 U.S.C. 154(b) by 119 days.

(21) Appl. No.: 12/737,939

(22) PCT Filed: Jul. 9, 2009

(86) PCT No.: PCT/EP2009/058720

§ 371 (c)(1),
(2), (4) Date: May 16, 2011

(87) PCT Pub. No.: WO2010/025977

PCT Pub. Date: Mar. 11, 2010

(65) Prior Publication Data

US 2011/0211914 A1 Sep. 1, 2011

(30) Foreign Application Priority Data

Sep. 4, 2008 (AT) ..... A 1381/2008

(51) Int. Cl.
*E02B 17/08* (2006.01)

(52) U.S. Cl.
USPC ..... 405/196; 405/13; 405/14; 405/195.1; 405/199; 182/141; 182/187

(58) Field of Classification Search
USPC ..... 405/195.1, 196, 197, 198, 199; 182/141, 187
See application file for complete search history.

(56) References Cited

U.S. PATENT DOCUMENTS

| | | | | | |
|---|---|---|---|---|---|
| 3,516,512 | A * | 6/1970 | Handschack et al. | ..... | 182/16 |
| 4,044,858 | A | 8/1977 | Vikre | | |
| 4,107,516 | A * | 8/1978 | Hvidsten | ..... | 377/17 |
| 4,861,196 | A | 8/1989 | Folse | | |
| 4,991,996 | A | 2/1991 | Tate | | |
| 5,324,140 | A * | 6/1994 | Lopez et al. | ..... | 405/188 |
| 2007/0007074 | A1 * | 1/2007 | Lemburg et al. | ..... | 182/128 |
| 2007/0193831 | A1 | 8/2007 | Vance | | |

FOREIGN PATENT DOCUMENTS

| | | | | |
|---|---|---|---|---|
| CA | 2354674 | | 2/2003 | |
| GB | 1158985 | | 7/1969 | |
| JP | 58083720 | * | 5/1983 | ..... 405/196 |
| WO | 8606121 | | 10/1986 | |
| WO | 9615342 | | 5/1996 | |
| WO | 2004051002 | | 6/2004 | |

OTHER PUBLICATIONS

English Abstract of WO2004051002.

* cited by examiner

*Primary Examiner* — Frederick L Lagman
*Assistant Examiner* — Carib Oquendo
(74) *Attorney, Agent, or Firm* — Dykema Gossett PLLC

(57) ABSTRACT

The invention relates to a maintenance platform (1, 10) for an oil rig equipped with a work platform and at least three frame legs (2) b, particularly a jackup oil rig, wherein at least one corner module (6) having at least one platform can be moved along at least one frame leg (2) of the oil rig, wherein the at least one corner module (6) is equipped with at least one climbing unit (110), which positively interacts with at least one gearing system (4) that is arranged on the frame leg (2) in order to bring about an up or down movement of the at least one corner module (6) along the frame leg (2).

15 Claims, 16 Drawing Sheets

MAINTENANCE PLATFORM FOR OFF-SHORE CONSTRUCTION

BACKGROUND OF THE INVENTION

1. Field of the Invention

The invention relates to a maintenance platform for an oil rig equipped with at least one work platform and at least three frame legs.

2. The Prior Art

A drilling platform or oil rig is an artificial support surface in the sea which is used for drilling for crude oil or natural gas. A classical oil platform has a fixed base of steel and/or concrete which is anchored on the sea bed. Another form of oil rigs is the jack-up oil rig (jack-up rig). It consists of at least three, frequently four, frame legs, wherein the work platform is vertically movable along the frame legs. Usually gearing systems are provided on the frame legs for the vertical movement of the work platform along the frame legs. Since these frame legs are usually made of steel, as a result of environmental influences such as salt water and wind or solar radiation, their regular maintenance is essential for the function of the platform. However, as a result of the exposed position of the frame legs, the maintenance work is hazardous and complicated.

Numerous devices have become known which make maintenance work in exposed positions, in particular in high structures, safer and easier. DE 25 52 191 describes a maintenance device for use below the work platform or support deck in particular in oil rigs, wherein a platform is movably secured on an arm located on the support deck and can be pivoted under the support deck.

EP 0 345 947 A1 describes an oil rig which has a maintenance deck which is vertically movable, underneath its work platform.

A disadvantage with these devices is that they can only be used underneath the work platform.

WO 96/15342 describes a maintenance platform which is disposed on a supporting column of an oil platform, wherein a retaining cable fastened to the platform is looped around the supporting column and two vertically running cables are provided, with the aid of which the work platform is vertically movable. A similar device can also be deduced from WO 86/06121.

US 2007/0007074 A1 finally describes a maintenance platform for rotor blades of wind turbines, wherein at least two platforms form a common work platform which is vertically movable by means of cables.

A disadvantage of the maintenance platforms described in the prior art is that the fixing of the platforms is accomplished by means of cables, with the result that these have only low stability so that in unfavourable weather, in particular in strong wind, they can only be used to a limited extent without endangering the safety of the maintenance staff.

DE 1 506 334 A discloses an apparatus comprising a lifting, transporting or bridge-forming platform, having a plurality of racks and pinions which engage in the racks, mounted on the platform. This apparatus is provided in particular for raising or lowering ships into the water in harbour installations and as a result of its fundamental structure is suitable for use on oil platforms.

It is therefore the object of the invention to provide a maintenance platform which can be used even at high wind strengths and provides a high degree of safety for maintenance staff.

SUMMARY OF THE INVENTION

This object is solved according to the invention by a maintenance platform of the type mentioned initially whereby at least one corner module having at least one platform can be moved along at least one frame leg of the oil rig, wherein the at least one corner module is provided with at least one climbing unit which interacts positively with at least one gearing system that is arranged on the frame leg in order to bring about an upward or downward movement of the at least one corner module along the frame leg.

The corner module is positively and therefore stably arranged on the frame leg by means of the climbing unit, wherein a gearing system disposed on the frame leg, generally a vertically running rack, is used to move the maintenance platform vertically along the frame leg. In this case, a gearing system additionally provided for the maintenance platform can be provided. It is preferable however that an already existing gearing system used for moving the work platform of the oil rig is used at the same time for the maintenance platform according to the invention. Hence, an already existing gearing structure is used for the movement of the maintenance platform and no additional cost-intensive measures are required to move the maintenance platform.

In a preferred embodiment of the invention, at least two corner modules are provided, which are detachably connected to one another by means of at least one connecting element in order to form a common platform, wherein at least one corner module is provided with at least one climbing unit. The maintenance platform according to the invention can therefore be constructed in modular design, wherein connecting elements or modules are arranged between the two corner modules, for example, by means of screw connections.

Preferably in this case, at least one corner module is arranged on a vertical edge of the frame leg of the oil rig so that when using at least two corner modules with at least one connecting module, a platform is formed which horizontally spans one flank of the frame leg to be maintained.

The frame legs can have different cross-sections, wherein preferably the frame leg of the oil rig has a substantially triangular, square or polygonal cross-section and respectively one corner module is arranged on each vertical edge of a frame leg, wherein respectively two adjacent corner modules are connected to one another by means of at least one connecting element, whereby a continuous platform encircling the frame leg is formed. This encircling platform allows complete maintenance of the frame leg in horizontal planes, wherein the entire maintenance platform can be moved vertically along the frame leg.

In a preferred embodiment of the invention, the climbing unit provided on at least one corner module comprises a rotatable climbing element provided with at least two, preferably three or more engagement elements, wherein a first engagement element is engageable in a first tooth spacing of the gearing system of the frame leg and upon twisting of the climbing element, a second engagement element is engageable in a second, tooth spacing adjacent to the first tooth spacing, whilst the first engagement element can be moved out from the first tooth spacing. The at least one corner module or the maintenance platform is secured positively on the frame leg by means of the climbing unit so that a particularly high stability of the maintenance platform is given.

In one variant of the invention, the at least one corner module of the maintenance platform encircling the frame leg has a climbing unit in order to be able to move the maintenance platform upwards and downwards along the frame leg. It is preferred however that each corner module of the maintenance platform encircling the frame leg has at least one, preferably two, climbing units. Hence the maintenance platform is positively arranged on each edge of the frame leg, whereby the stability of the maintenance platform particularly during the vertical movement along the frame leg is substantially improved compared with the prior art.

Preferably each climbing unit has a pulse counting system. The respective climbing units are interconnected via this system in terms of control technology so that a climbing unit is guided over, for example, missing teeth in the gearing system of a frame leg and consequently, an improved stability and associated with this an increased safety of the maintenance platform according to the invention is given. Each corner module is additionally guided vertically with the aid of the parallel side flanks of the teeth of the gearing system and the plane formed by the teeth heads.

In order to be able to carry out maintenance of the frame leg in more than one plane, in a preferred embodiment of the invention the corner module has two platforms arranged parallel to one another. Thus, a larger area of the frame leg can be maintained in a given position of the maintenance platform.

The at least one connecting element arranged between two adjacent corner modules serves on the one hand to connect these corner modules, on the other hand additional devices can be provided on this connecting element. Thus, in a preferred embodiment of the invention, the connecting element is configured as a crane module with a crane.

In another embodiment, the at least one connecting element has a load transporting device, for example, a lift.

In yet another embodiment an aerial work platform is arranged on the at least one connecting module, which allows better access to exposed regions of the frame leg.

In addition, it can be provided that the at least one connecting element has an additional pivotable or telescopically extendable platform via which, if necessary, the region of the frame leg lying on the inside is accessible.

Preferably two extendable platforms are arranged on each corner module, which platforms in the extended state substantially enclose that vertically running strut, known as "strap" in technical language, on which the at least one climbing unit is arranged so that the inner side thereof can be safely maintained.

In order to protect the service personnel and the equipment located on the maintenance platform from weather influences, in a particularly preferred embodiment of the invention a roofing or a housing of the maintenance platform is additionally provided.

BRIEF DESCRIPTION OF THE DRAWINGS

The invention will be explained in detail hereinafter with reference to non-restrictive exemplary embodiments with appurtenant figures. In the figures.

DETAILED DESCRIPTION OF THE PREFERRED EMBODIMENT

Figure 1:
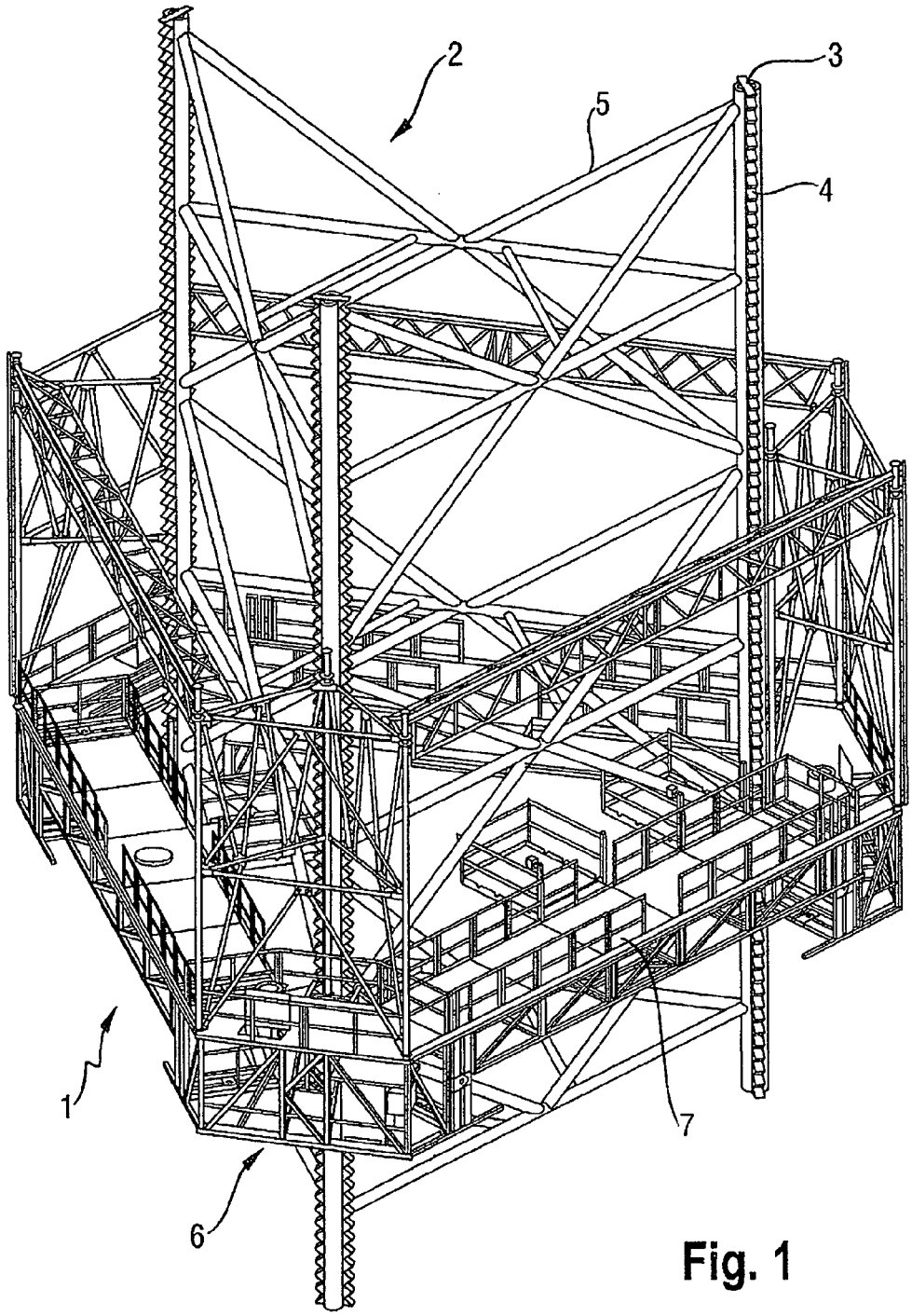
FIG. 1 shows an isometric view of a maintenance platform according to the invention which spans a frame leg of an oil rig.
Figure 2:
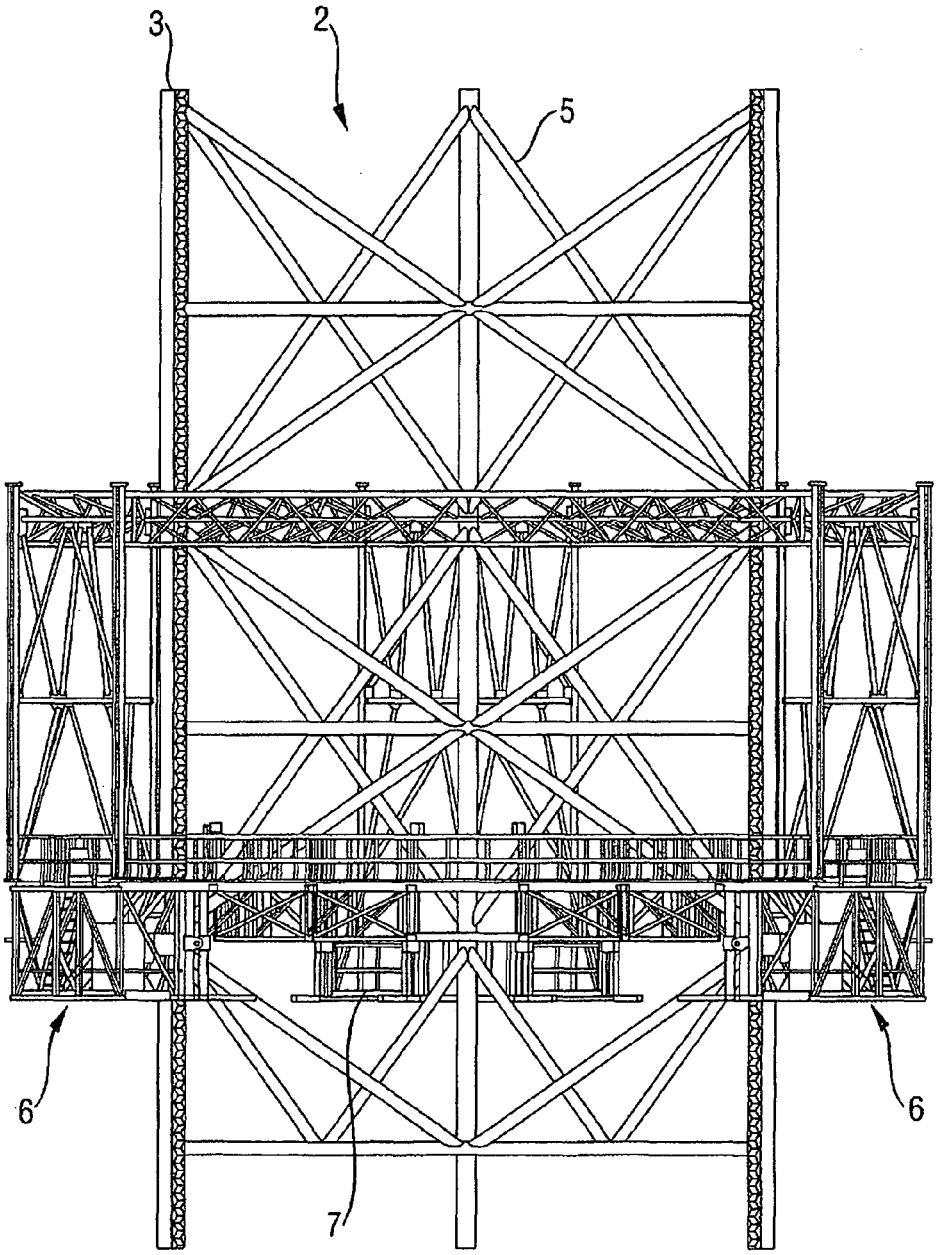
FIG. 2 shows a front view of the maintenance platform from FIG. 1.

As shown in FIG. 1 and FIG. 2, the maintenance platform 1 according to the invention is arranged on a frame leg 2 of a jack-up oil rig which has a triangular cross-section. The frame leg 2 consists of three vertically running struts 3, so-called straps, each having two mutually opposed racks of gearing system 4. In order to impart sufficient stability to the struts 3, supporting struts 5 are provided in a manner known per se, which interconnect the individual straps 3. The maintenance platform 1 has three corner modules 6 which are each arranged on a vertical strut 3 of the frame leg 2. A plurality of connecting elements 7 are arranged in a modular manner between the corner modules 6 so that a connection is formed between the neighboring corner modules 6.

Figure 3:
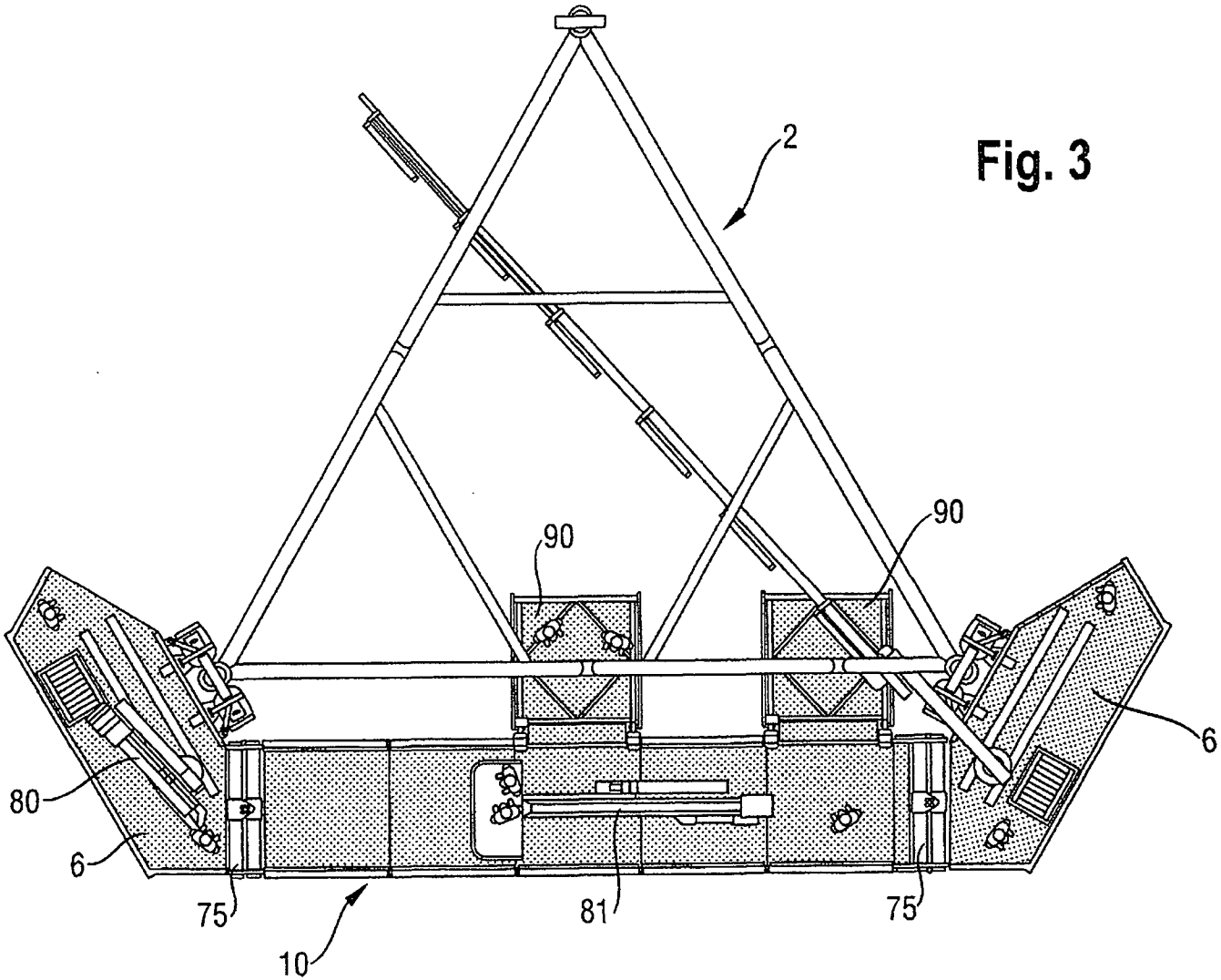
FIG. 3 shows a maintenance platform arranged on a flank of a frame leg.
Figure 8:
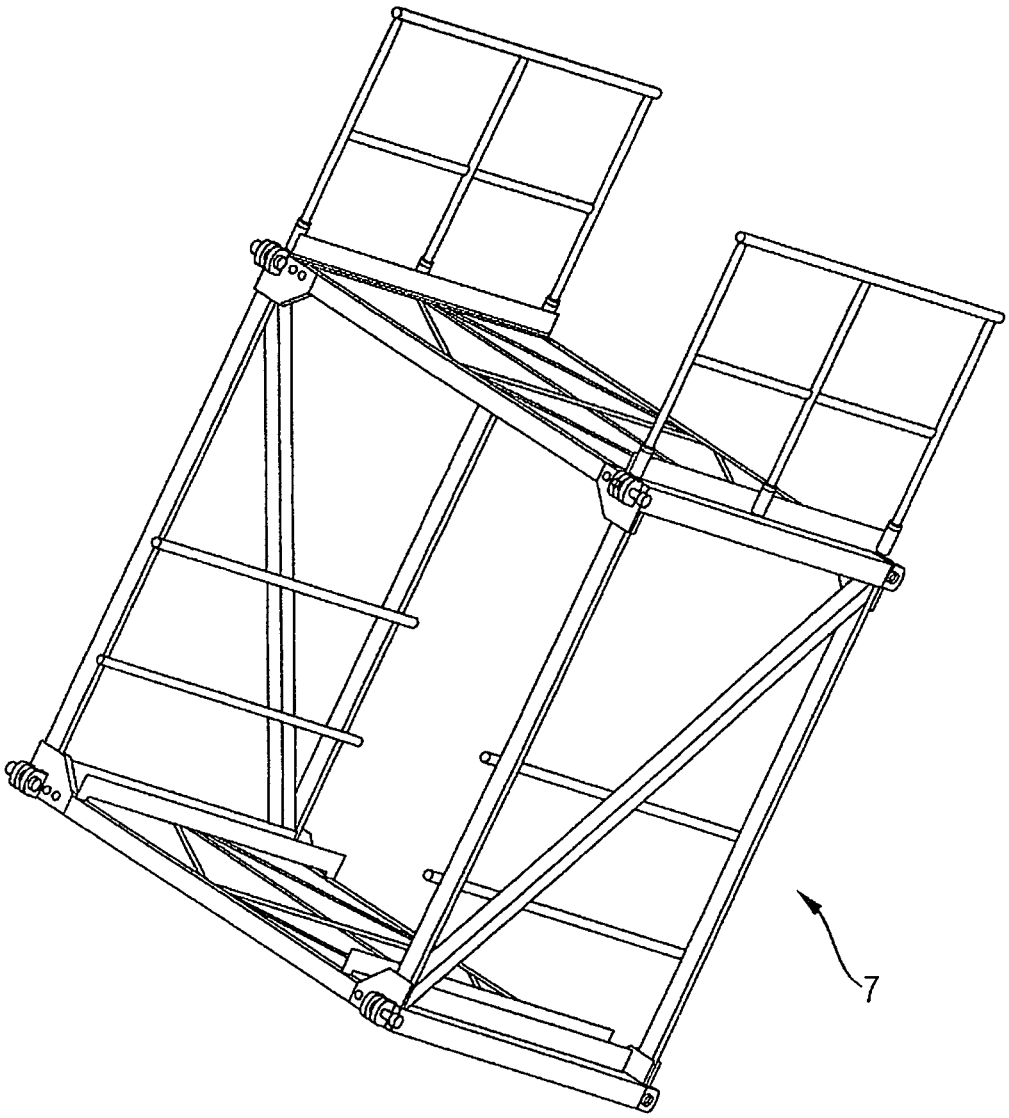
FIG. 8 shows a connecting element.

FIG. 3 shows a maintenance platform 10 consisting of two corner modules 6 and five connecting modules 7 arranged between the corner modules 6, which are arranged along a flank of the frame leg 2. The two corner modules 6 are each equipped with a crane device 80 whilst a lifting platform device 81 is arranged on one of the connecting elements 7. This connecting element 7 additionally has an additional platform 90 which projects into the interior of the frame leg 2. The connecting elements 7 preferably comprise standard modules such as is shown in FIG. 8, for example, wherein its range of application can be varied with the aid of modifications of the standard module.

As a result of the standardised size of the connecting elements 7, additional compensating modules 75 (FIG. 11) are provided, which are arranged between the connecting elements 7 and the corner modules 6 in order to adapt the connection between the corner modules 6 to the flank length of the frame leg 2.

Figure 4:
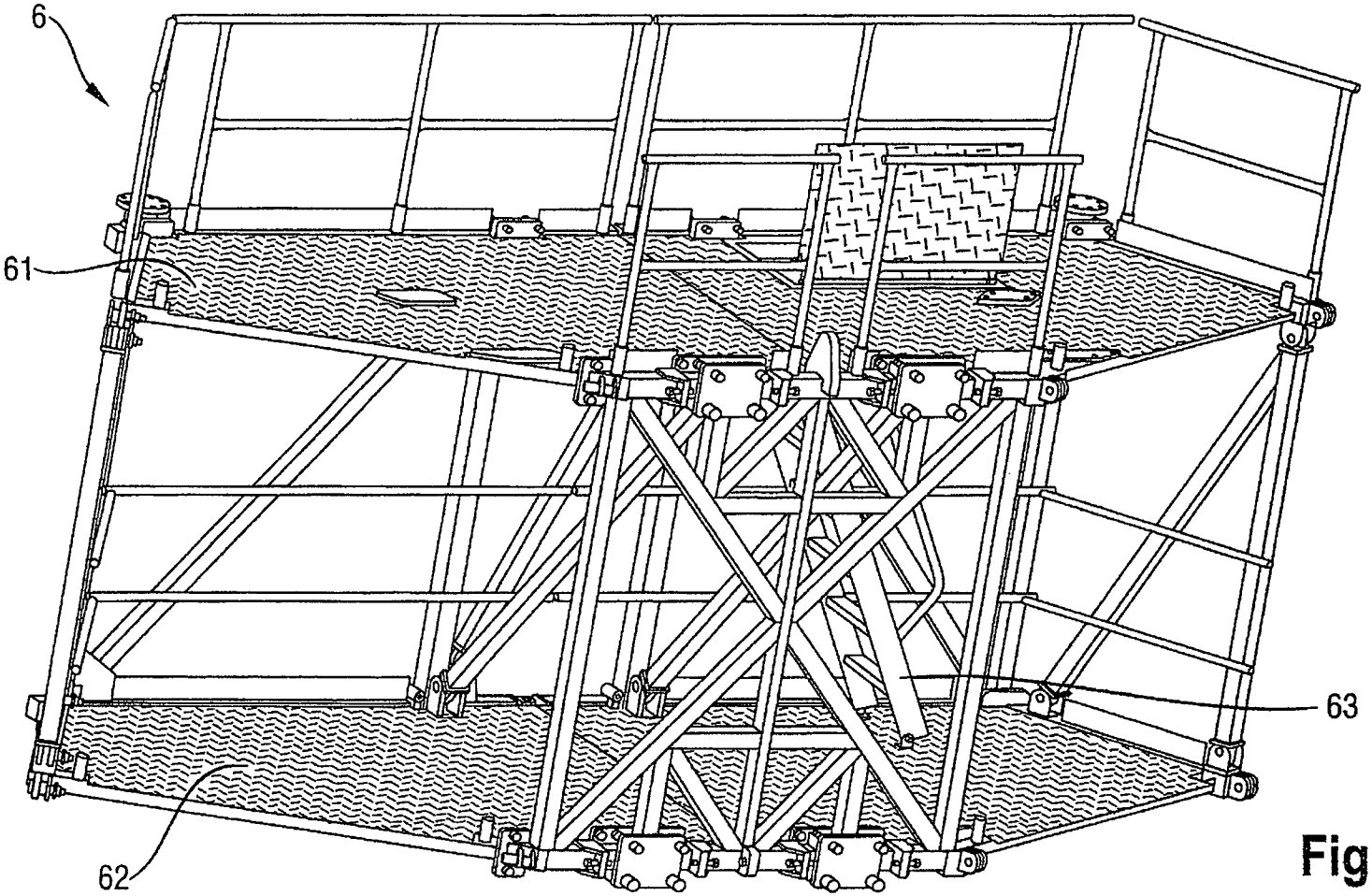
FIG. 4 shows an isometric view of a corner module without climbing device.

FIG. 4 shows a corner module 6, where this comprises two platforms 61, 62 arranged one above the other which are interconnected in a walkable manner, for example, by means of a ladder 63.

Figure 5:
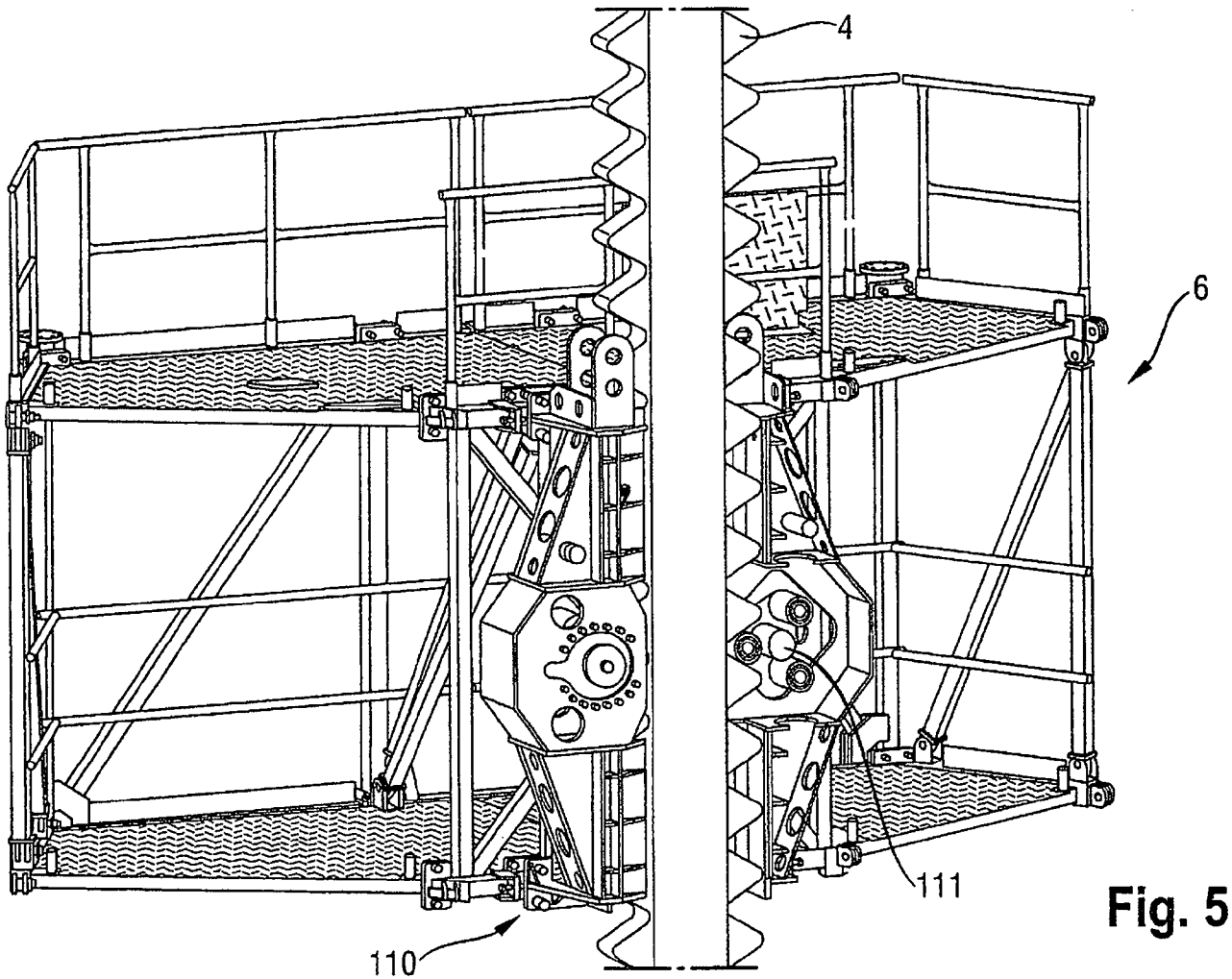
FIG. 5 shows an isometric view of a corner module with climbing device.

FIG. 5 shows a further corner module 6 which is equipped with a climbing device 110. This climbing device 110 is positively connected to the gearing system of the racks 4 arranged on the strut 3 of the frame leg 2, a climbing element 111 which engages in the gearing system being provided.

Figure 6:
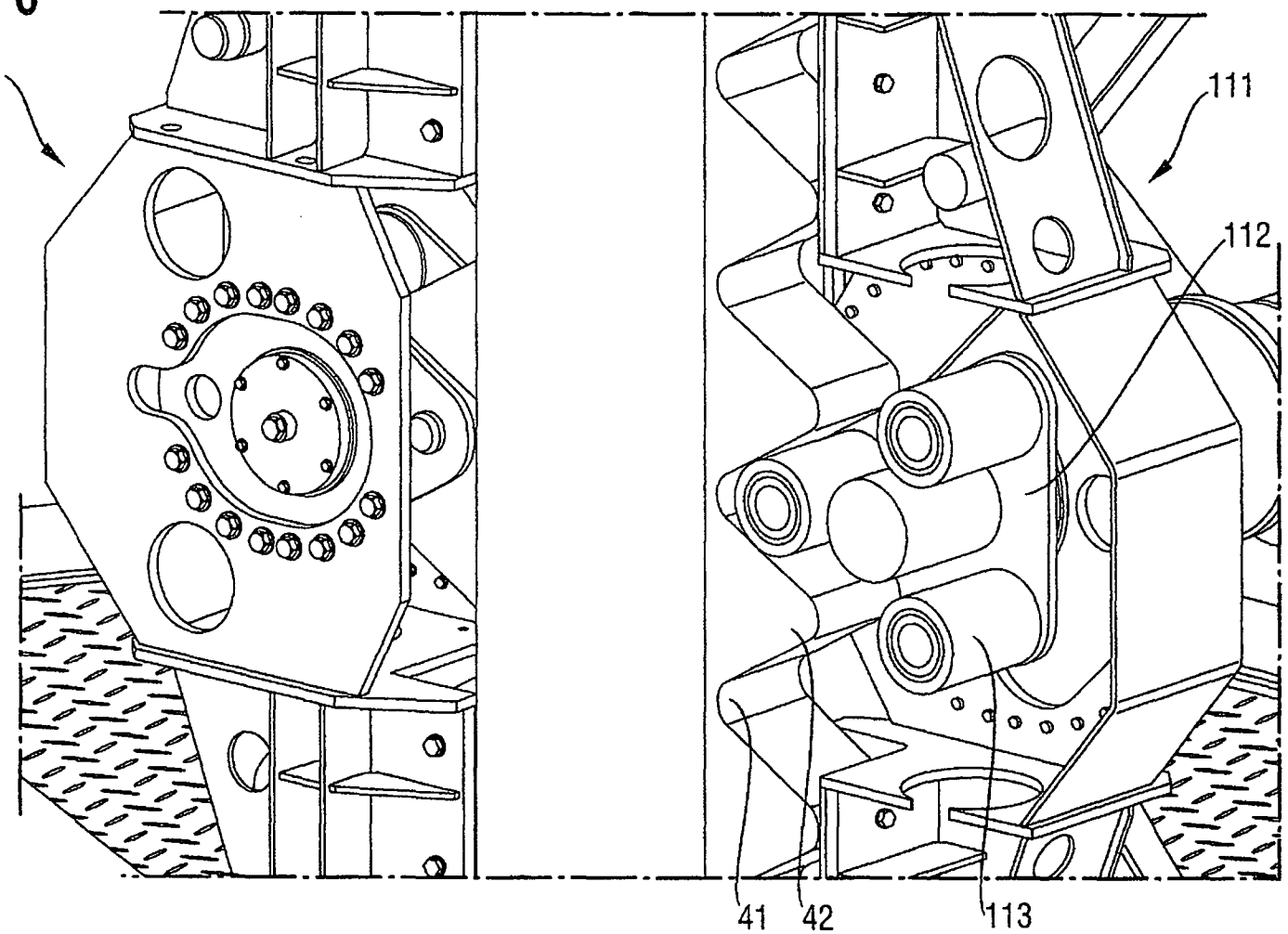
FIG. 6 shows a detailed view of the climbing device from FIG. 5.
Figure 7:
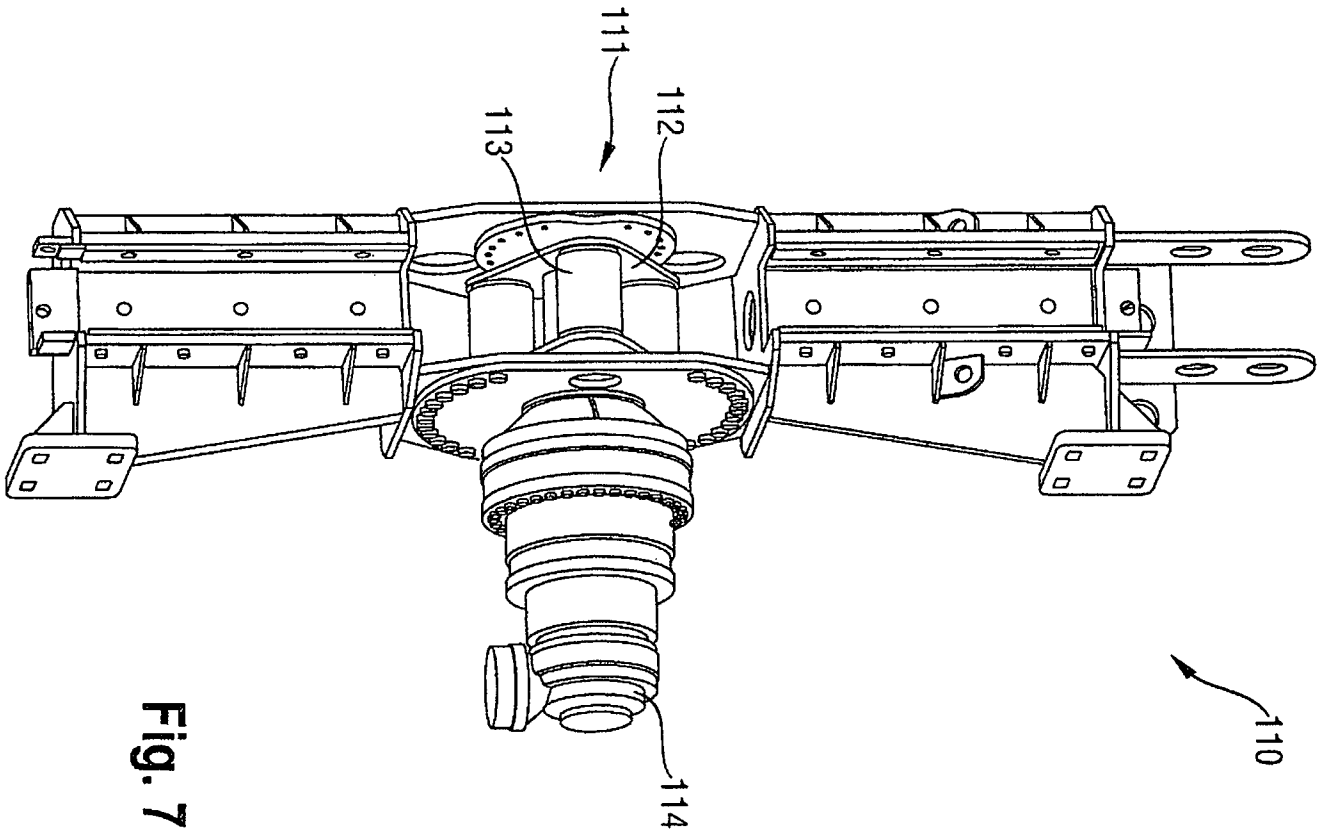
FIG. 7 shows a side view of the climbing device from FIG. 5.

This climbing element 111 is shown in detail in FIG. 6 and FIG. 7. This has three or four (FIG. 7) engagement elements 113 configured as lever arms arranged on a rotatable plate 112, which each engage alternately in adjacent spacings 41 of neighbouring teeth 42 of the gearing system 4. The engagement elements 113 (FIG. 6) located in the plate 112, arranged in a triangle, are twisted in a manner known per se by means of a drive 114.

Figure 9A:
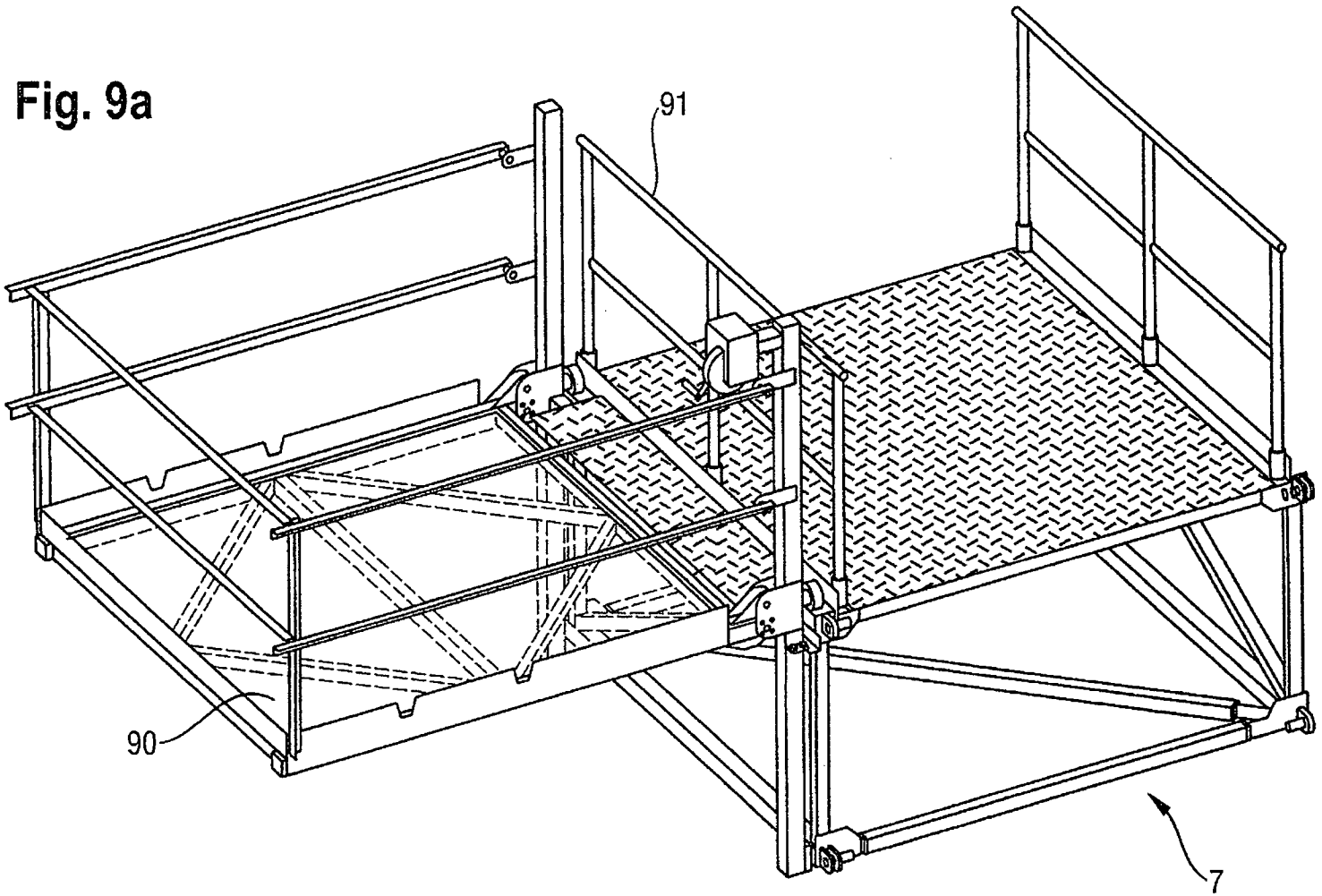
FIG. 9*a* shows a connecting element with pivotable additional platform in the folded-out position.
Figure 9B:
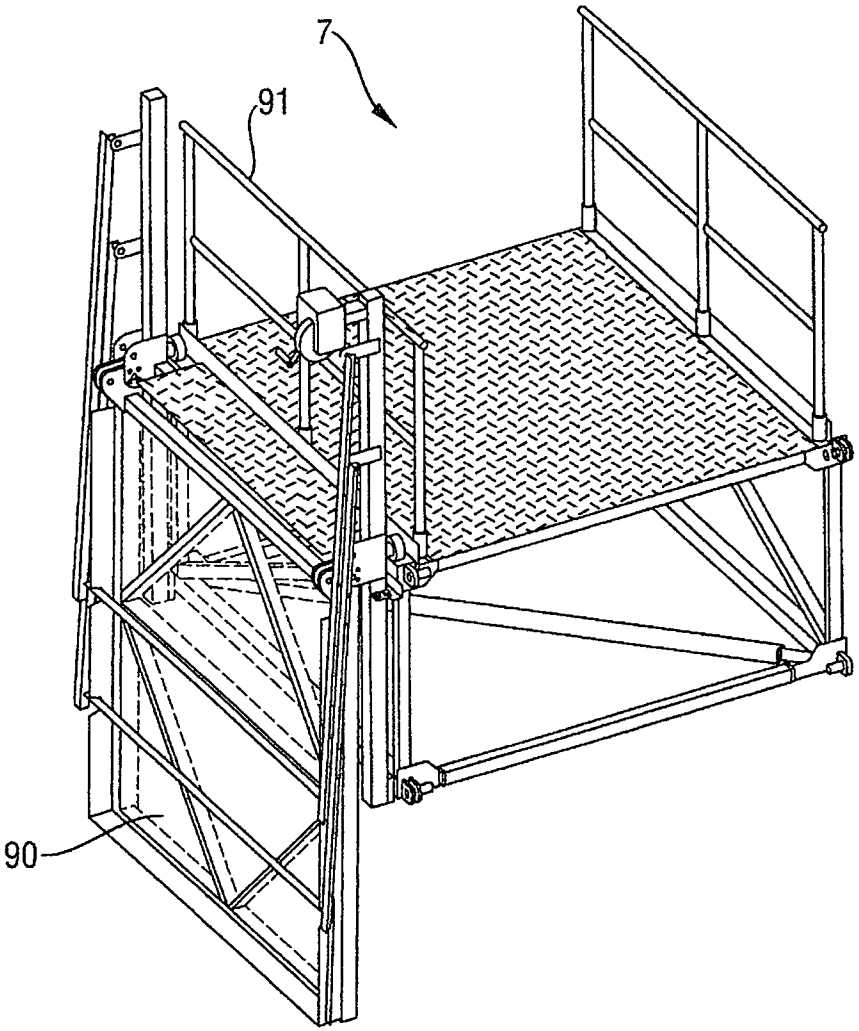
FIG. 9*b* shows the connecting element from FIG. 9*a* with folded-down additional platform.

FIG. 9*a* shows a connecting element 7 which has a fold-away additional platform 90, wherein access to the additional platform 90 is secured by means of horizontally movable barriers 91. As shown in FIG. 9*b*, the additional platform 90 can be pivoted vertically by 90° so that during vertical upward or downward movement of the maintenance platform 1 along the frame leg 2, the additional platform 90 does not collide with supporting struts 5 of the frame leg 2.

Figure 10:
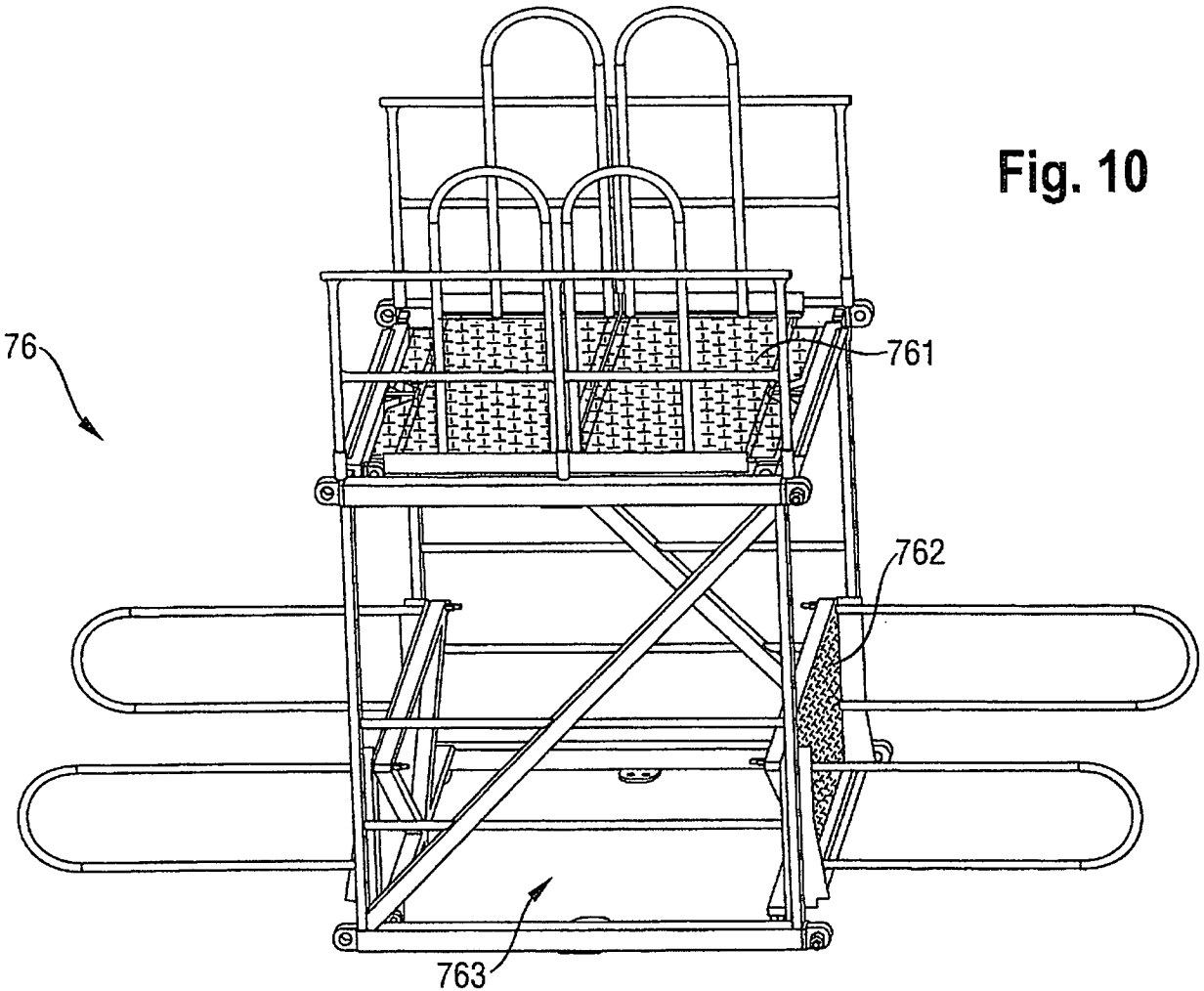
FIG. 10 shows a connecting element for a lift device.

FIG. 10 shows a so-called lift module 76 which has two platforms 761, these two platforms 761 being designed as two-part. The two platform segments 762 can each be pivoted by 90° so that as to provide a passage 763 through which a loading device, for example, a lift can be passed (not shown).

Figure 11:
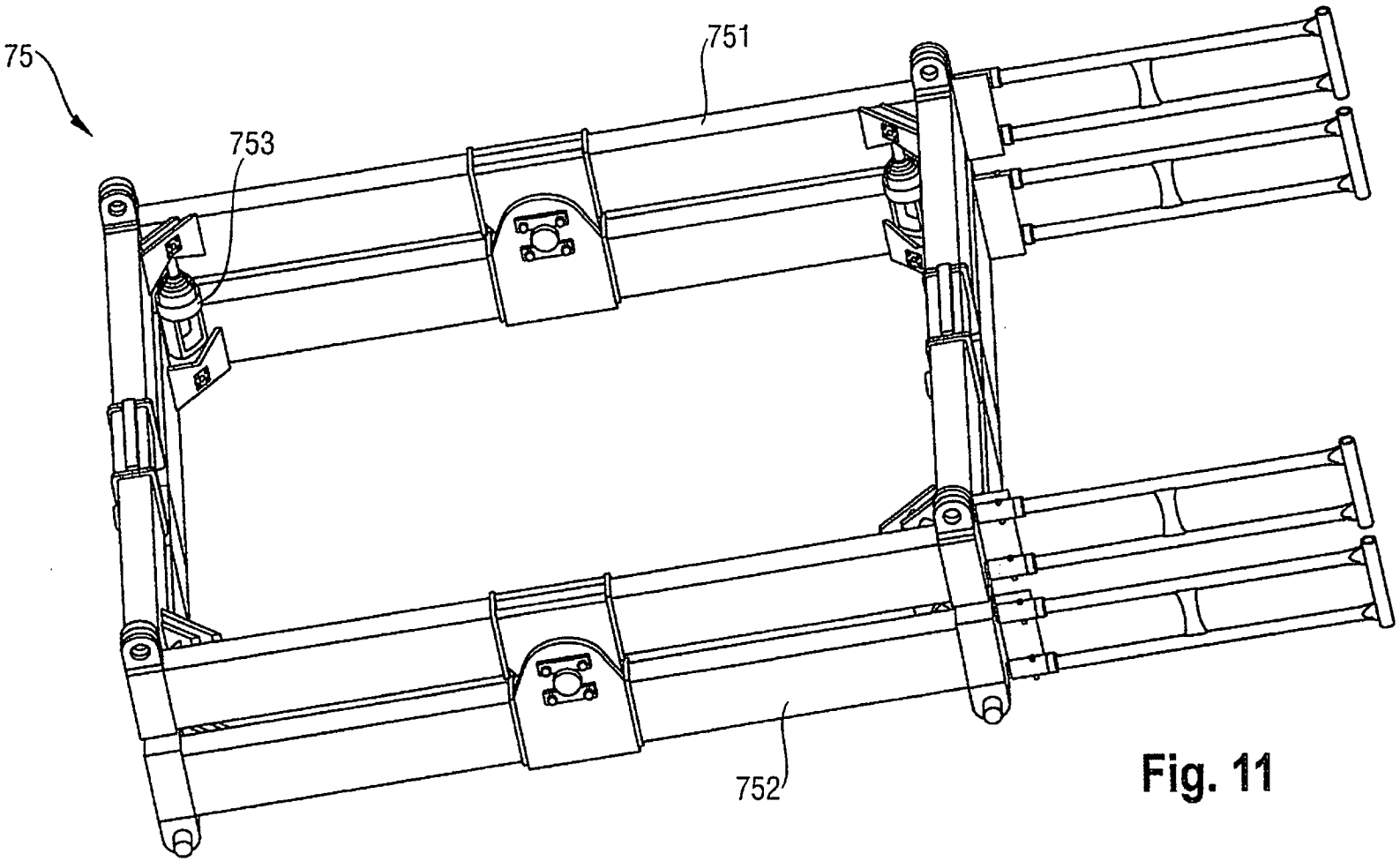
FIG. 11 shows a compensating module.

The compensating module 75 shown in FIG. 11, as already mentioned above, serves to compensate for the length of the connecting web between two corner modules 6. It consists of two frame elements 751 and 752 by which means the compensating module 75 can be fastened to an end module 6 or connecting element 7, for example, by means of screw connections. Since the tolerances in distances of two adjacent straps 3 with respect to one another can be up to 100 mm, these must be taken into account in the connection of the corner modules 6 to the connecting elements 7 both in the length and in the angle (up to 5°). For this the compensating modules 75 preferably have spring elements 753 arranged in the corners of the compensating module 75, whose task consists in exerting an additional pre-tensioning force (tension or pressure) whilst maintaining the longitudinal and angular compensation in order to achieve a closed guidance.

Figure 12A:
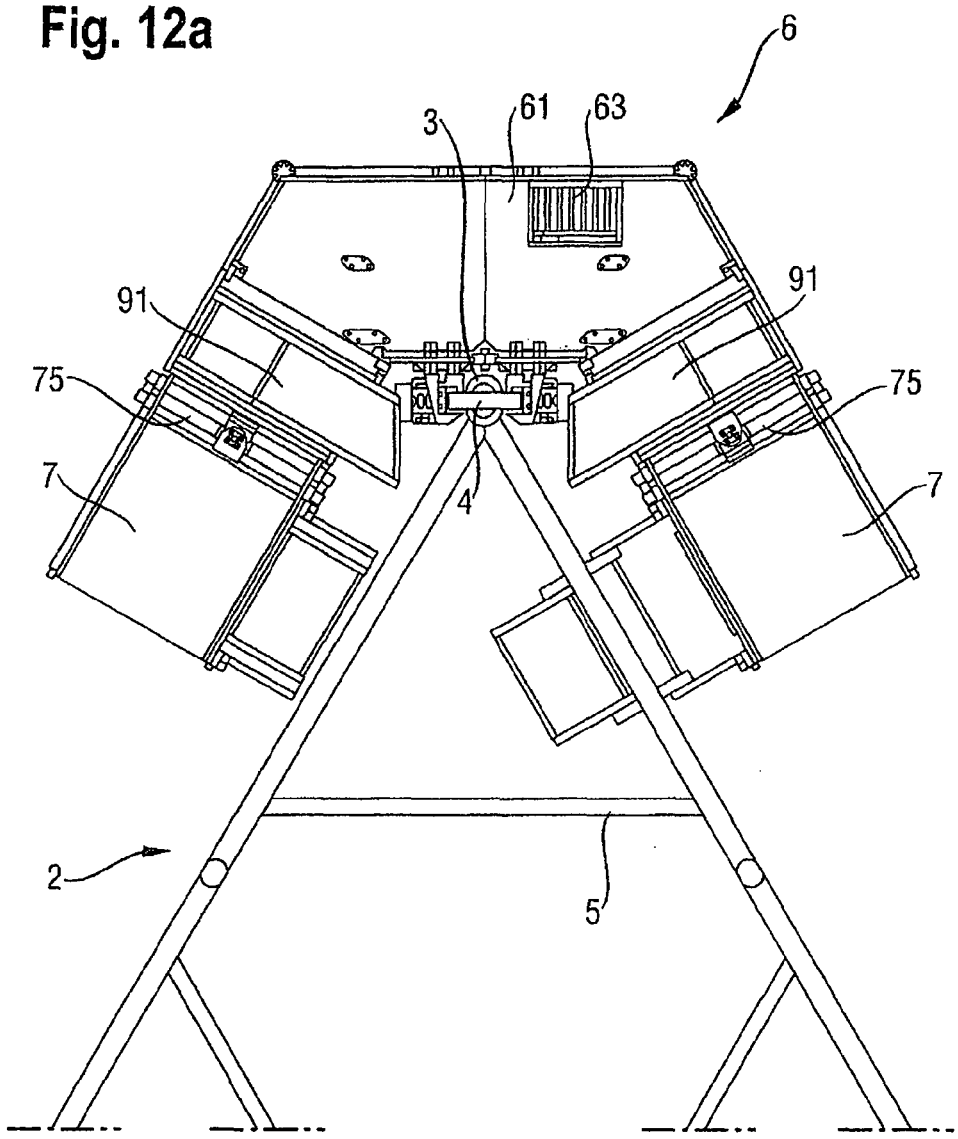
FIG. 12*a* shows a corner module viewed from above.
Figure 12B:
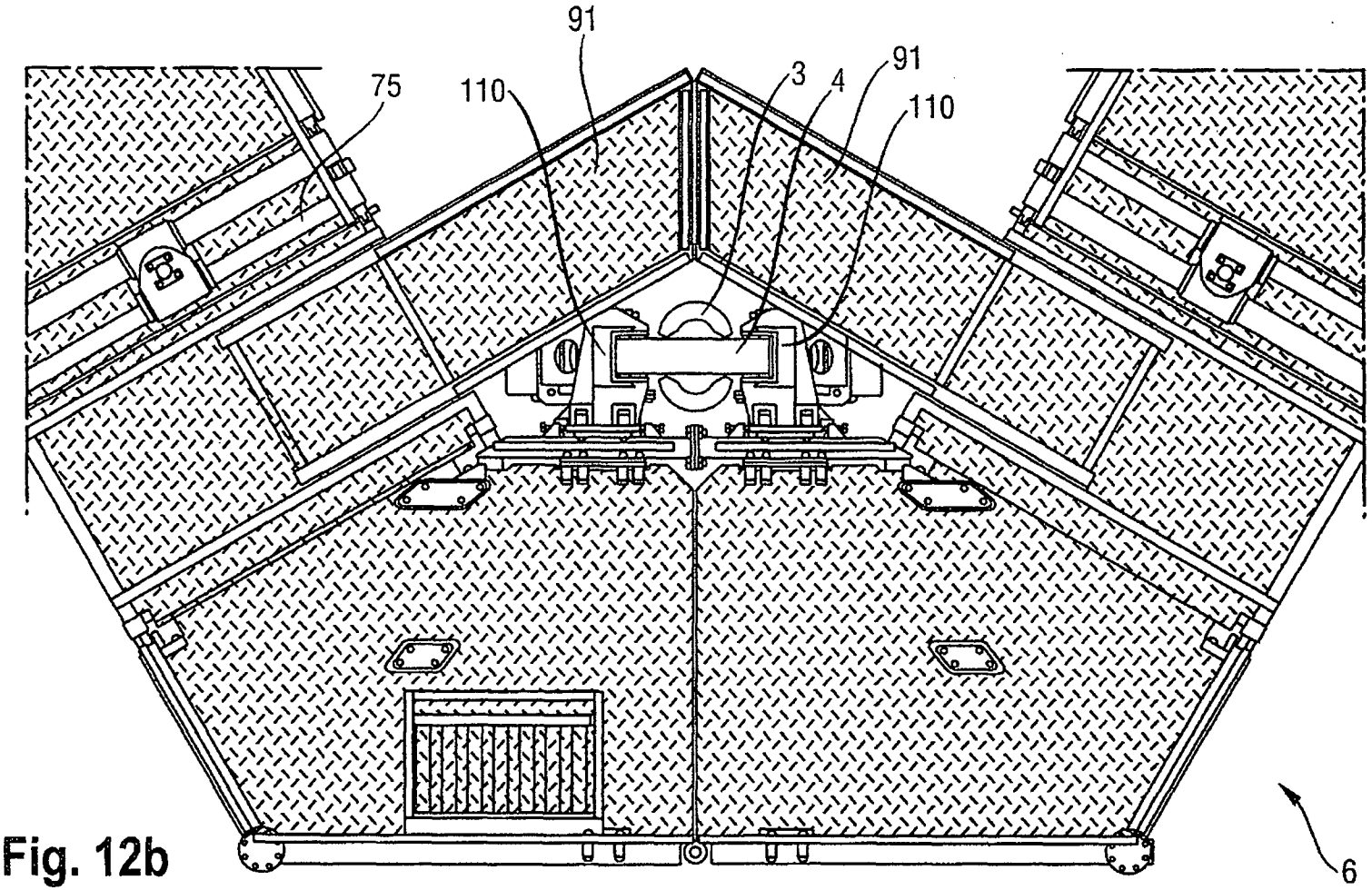
FIG. 12*b* shows a detailed view of the corner module from FIG. 12*a* with extended platforms.

FIG. 12*a* shows a corner module 6 which has two extendable platforms 90 which are each arranged in the connecting region of the compensating modules 75 adjoining the corner module 6. In the extended state (FIG. 12*b*) a continuous work platform is created, which encloses the struts 3 having two synchronously interacting climbing elements 111 of the climbing unit 110 arranged at the gearing system 4 thereof, by which means the inner side of the strap 3 is easily accessible for inspection and/or maintenance.

Figure 13:
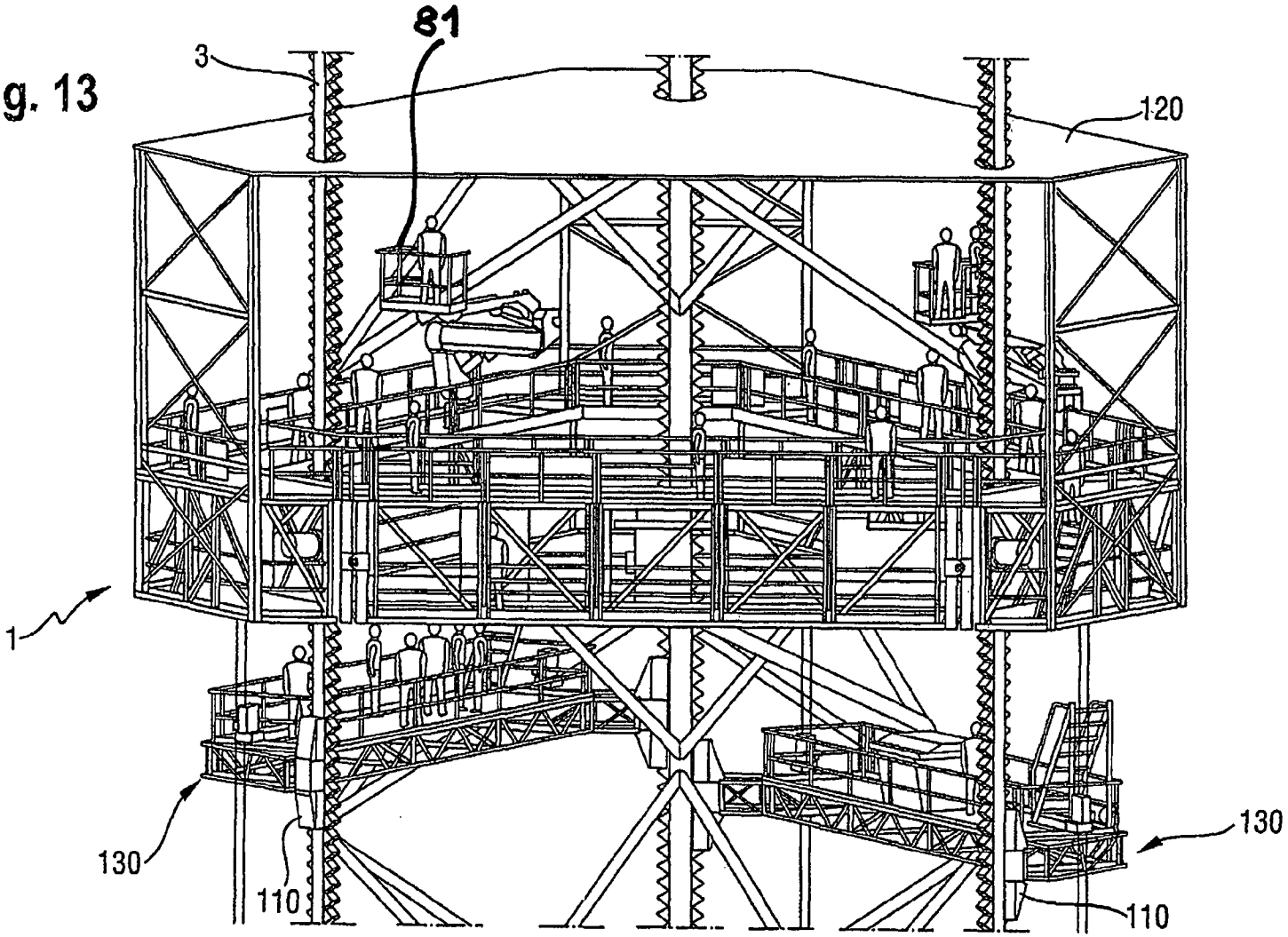
FIG. 13 shows a maintenance platform with roofing.

FIG. 13 again shows the maintenance platform from FIG. 1, where a roofing 120 is provided, which is spanned between the three vertical struts 3 of the frame leg 2 to provide protection against the weather.

In addition, further auxiliary platforms 130 are located below the maintenance platform 1 encircling the frame leg 2, their length substantially corresponding to the flank length of the frame leg. Respectively one climbing unit 110 is provided at the corner points of the auxiliary platforms 130, with the aid of which the auxiliary platform 130 can be moved vertically along the gearing system 4 of two vertical struts 3 independently of the maintenance platform 1.

Figure 14:
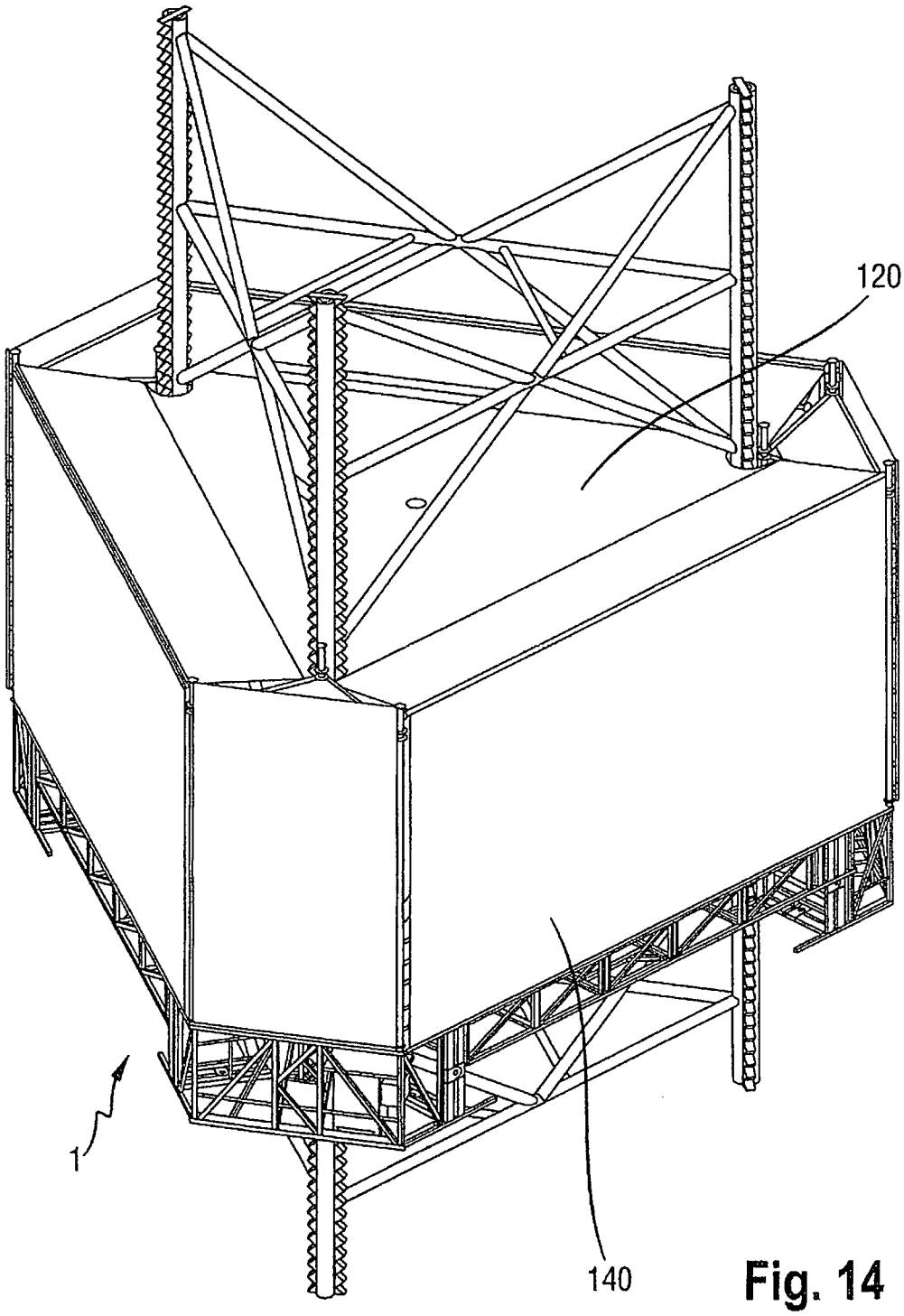
FIG. 14 shows a maintenance platform with complete housing.

In order to protect the maintenance platform as far as possible from the influences of weather, according to FIG. 14 the maintenance platform 1 has, along with the roofing 120, a segment-like housing 140 which completely covers the side surfaces of the maintenance platform 1.

It is understood that the invention is not restricted to the exemplary embodiments described above. It is essential that the maintenance platform 1 can be moved with the aid of at least one climbing unit 110 along a gearing system on a frame leg 2 as is the modular structure of the maintenance platform 1. In this case, either in the case of a jack-up oil rig, a tooth system already provided on the frame leg can be used or an additionally installed gearing system can be provided. By arranging a corner module 6 on a vertical strut of the frame leg 2 and optionally the connection of one or more connecting elements 7 to the corner model 6, a modular maintenance platform 1 is constructed in a modular manner, its length and equipment being adapted to the respective frame legs 2 of the oil rig. A plurality of different connecting elements are available here having additional devices such as cranes 80, lifting platforms 81 and/or additional platforms 90, whereby an optimal adaptation of the maintenance platform 1 according to the invention to the different requirements for maintenance of frame legs 2 is achieved.

The invention claimed is:

1. A maintenance platform for an oil rig, the oil rig being equipped with at least one work platform and at least three frame legs, wherein at least one corner module having at least one platform can be moved along at least one frame leg of the oil rig, wherein the at least one corner module is provided with at least one climbing unit which interacts positively with at least one gearing system that is arranged on the at least one frame leg, wherein the at least one climbing unit consists of at least two engagement elements arranged on a rotatable plate, a longitudinal axis of the at least two engagement elements being perpendicular to a plane of said rotatable plate, wherein a first engagement element is engageable in a first tooth spacing of the gearing system of the at least one frame leg and upon rotating of the climbing element, a second engagement element is engageable in a second tooth spacing adjacent to the first tooth spacing, while the first engagement element can be moved out from the first tooth spacing.

2. The maintenance platform according to claim 1, including at least two corner modules which are detachably connected to one another by means of at least one connecting element in order to form a common platform, and wherein at least one corner module includes at least one climbing unit.

3. The maintenance platform according to claim 1, wherein each climbing unit includes a pulse counting system.

4. The maintenance platform according to claim 1, wherein the at least one frame leg of the oil rig has a substantially triangular, square or polygonal cross-section and respectively at least one corner module is arranged on each vertical edge of at least one frame leg, wherein respectively two adjacent corner modules are connected to one another by means of at least one connecting element, whereby a continuous platform encircling the at least one frame leg is formed.

5. The maintenance platform according to claim 4, wherein at least one corner module of the maintenance platform encircling the at least one frame leg includes at least one climbing unit.

6. The maintenance platform according to claim 4, wherein each corner module of the maintenance platform encircling the at least one frame leg includes at least one climbing unit.

7. The maintenance platform according to claim 4, wherein each corner module of the maintenance platform encircling the at least one frame leg includes two climbing units.

8. The maintenance platform according to claim 1, wherein the at least one corner module includes two platforms arranged parallel to one another.

9. The maintenance platform according to claim 1, wherein the at least one connecting element is configured as a crane module with a crane.

10. The maintenance platform according to claim 1, wherein the at least one connecting element includes a load transporting device.

11. The maintenance platform according to claim 1, wherein an aerial work platform is arranged on the at least one connecting module.

12. The maintenance platform according to claim 1, wherein the at least one connecting element has at least one additional pivotable or telescopically-extendable platform.

13. The maintenance platform according to claim 1, wherein two extendable platforms are arranged on each corner module, which platforms in an extended state substantially enclose at least one vertically running strut of the at least one frame leg on which the at least one climbing unit is arranged.

14. The maintenance platform according to claim 1, including a roofing.

15. The maintenance platform according to claim 1, including a housing.

* * * * *

UNITED STATES PATENT AND TRADEMARK OFFICE

CERTIFICATE OF CORRECTION

PATENT NO. : 8,585,324 B2
APPLICATION NO. : 12/737939
DATED : November 19, 2013
INVENTOR(S) : Hubert Palfinger It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 193 days.

Signed and Sealed this
Twenty-second Day of September, 2015

Michelle K. Lee

Michelle K. Lee
*Director of the United States Patent and Trademark Office*